US011453469B2

(12) United States Patent
Seo

(10) Patent No.: US 11,453,469 B2
(45) Date of Patent: Sep. 27, 2022

(54) STATIONARY LIFE-SAVING UNIT LAUNCHER

(71) Applicant: GAHM DESIGN CO., LTD, Daegu (KR)

(72) Inventor: Sang Deog Seo, Daegu (KR)

(73) Assignee: GAHM DESIGN CO., LTD, Daegu (KR)

( * ) Notice: Subject to any disclaimer, the term of this patent is extended or adjusted under 35 U.S.C. 154(b) by 0 days.

(21) Appl. No.: 17/053,163

(22) PCT Filed: Aug. 6, 2019

(86) PCT No.: PCT/KR2019/009834
§ 371 (c)(1),
(2) Date: Nov. 5, 2020

(87) PCT Pub. No.: WO2020/105837
PCT Pub. Date: May 28, 2020

(65) Prior Publication Data

US 2021/0237840 A1 Aug. 5, 2021

(30) Foreign Application Priority Data

Nov. 21, 2018 (KR) ..... 10-2018-0144054

(51) Int. Cl.

| | |
|---|---|
| ***B63C 9/22*** | (2006.01) |
| ***F41B 11/62*** | (2013.01) |
| ***F41B 11/72*** | (2013.01) |
| *F41B 11/80* | (2013.01) |
| *G08B 25/00* | (2006.01) |

(52) U.S. Cl.
CPC ..... *B63C 9/22* (2013.01); *F41B 11/62* (2013.01); *F41B 11/72* (2013.01); *F41B 11/80* (2013.01); *G08B 25/00* (2013.01)

(58) Field of Classification Search
None
See application file for complete search history.

(56) References Cited

U.S. PATENT DOCUMENTS 6,935,911 B1 * 8/2005 Stewart ..... B63C 9/21 441/81

FOREIGN PATENT DOCUMENTS

CN 204527587 U * 8/2015
CN 205784867 U 12/2016
(Continued)

OTHER PUBLICATIONS

International Search Report dated Dec. 6, 2019 in corresponding International application No. PCT/KR2019/009834; 4 pages.
(Continued)

*Primary Examiner* — Reginald S Tillman, Jr.
(74) *Attorney, Agent, or Firm* — Maier & Maier, PLLC

(57) ABSTRACT

A stationary life-saving unit launcher. The stationary life-saving unit launcher includes: a base; a compressed gas tank mounted to an upper portion of the base and supplying compressed gas; a frame mounted above the base by being spaced apart by a predetermined distance therefrom; and a launch unit mounted to the frame and firing a life-saving unit by using the impact force of the compressed gas supplied from the compressed gas tank. The launch unit is capable of firing a projectile without a loading motion for firing the life-saving unit after the mounting thereof.

6 Claims, 16 Drawing Sheets

(56) References Cited

FOREIGN PATENT DOCUMENTS

| | | | |
|---|---|---|---|
| CN | 207826501 | U | 9/2018 |
| CN | 111210597 | A | 5/2020 |
| JP | H11-59585 | A | 3/1999 |
| JP | 2002-137790 | A | 5/2002 |
| KR | 10-2013-0117273 | A | 10/2013 |
| KR | 10-1342195 | B1 | 12/2013 |
| KR | 10-1391315 | B1 | 5/2014 |
| KR | 10-1609801 | B1 | 4/2016 |
| KR | 10-1790940 | B1 | 10/2017 |

OTHER PUBLICATIONS

Search Report dated Jan. 7, 2022 in corresponding European Application No. 19886640.2, 7 pages.
Office Action dated Oct. 29, 2021 in corresponding Japanese Application No. 2021-506604, 6 pages including English-language translation.
Office Action dated Jan. 21, 2019 in corresponding Korean Application No. 10-2018-0144054, 4 pages including English-language translation.
Adam Garland, "Life Vest Launcher", College of Engineering and Applied Science, University of Cincinnati, Apr. 2015, 77 pages.

* cited by examiner

STATIONARY LIFE-SAVING UNIT LAUNCHER

FIELD

The present invention relates generally to a stationary life-saving unit launcher. More particularly, the present invention relates to a stationary life-saving unit launcher which a life-saving unit can be launched immediately after being mounted to a gun barrel without the loading motion of moving a loading handle backward to rapidly respond to accidents; the rotation angle of the gun barrel is limited to prevent the accidents; and when the life-saving unit is launched, accident information is transmitted to a fire department server, a police department server, and a local government server such that follow-up measures are efficiently taken.

BACKGROUND

Generally, accidents related to human life occur in various places such as on water, sea, land, ice, and on a ship. Particularly, life-saving activities are limited in life-threatening accidents that occur on the water or at sea due to the specificity of the location of the accidents.

For example, as time passes after an accident, a person who has fallen into the water will drift away from land or a ship due to the influence of flow velocity or current. In this case, a rescuer approaches a drowning person (a person who has fallen into the water) by swimming or using a lifeboat to rescue the victim by using a life-saving unit such as a tube or rope or by extending a hand.

However, in an urgent situation in which urgent rescue is required, it is not possible to quickly access the drowning person without skilled water safety personnel or marine rescue equipment such as lifeboats, and the safety of the drowning person and the rescuers cannot be guaranteed depending on weather conditions.

To solve such a problem, a conventional shoulder life-saving unit launcher is disclosed.

However, the shoulder life-saving unit launcher is heavy, which makes it difficult for the elderly to use the launcher.

Meanwhile, in the shoulder life-saving unit launcher, a loading motion of moving a loading handle backward to hold a holding part in a holding groove is required, which makes rapid response difficult.

In addition, as for the shoulder type life-saving unit launcher, a projectile may be unintentionally launched toward people adjacent to the launcher, so accidents may happen.

Accordingly, a new way of a life-saving unit launcher which can effectively solve the problem of such a shoulder life-saving unit launcher is urgently required to be developed.

(Patent Document 1) Korean Patent No. 10-1790940

SUMMARY

The present invention has been proposed to solve the above problems, and is intended to propose a life-saving unit launcher, wherein a projectile can be rapidly launched without a loading motion.

In addition, the present invention is intended to propose a life-saving unit launcher, wherein the rotation angle of a gun barrel is limited.

Furthermore, the present invention is intended to propose a life-saving unit launcher, wherein when a life-saving unit is launched, accident information is transmitted to a fire department server, a police department server, and a local government server.

The present invention provides a stationary life-saving unit launcher firing a life-saving unit such that the life-saving unit reaches a distant target point, the launcher including:

a base;

a compressed gas tank mounted to an upper portion of the base and supplying compressed gas;

a frame mounted above the base by being spaced apart by a predetermined distance therefrom; and a launch unit mounted to the frame and firing the life-saving unit by using an impact force of the compressed gas supplied from the compressed gas tank, wherein the launch unit is capable of firing a projectile without a loading motion for firing the life-saving unit after mounting thereof.

In addition, the launcher may further include: a lower cover covering an upper circumference of the base; and an upper cover covering an upper circumference of the frame, wherein a front portion of the upper cover at which a gun barrel of the launch unit is arranged and a rear portion of the upper cover at which a launch button of the launch unit is arranged may be simultaneously opened or closed.

Furthermore, the upper cover may include:

a first cover having a U shape formed by two first vertical parts and a first horizontal part connecting the two first vertical parts to each other, the first cover being fixed to the upper portion of the base such that the first horizontal part is directed upward;

a second cover having a U shape formed by two second vertical parts and a second horizontal part connecting the two second vertical parts to each other, and being arranged on an upper portion of the frame such that the second horizontal part is directed upward, with a first handle being coupled to one side of the second vertical parts;

a third cover having a U shape formed by two third vertical parts and a third horizontal part connecting the two third vertical parts to each other, and being arranged on the upper portion of the frame such that the third horizontal part is directed upward and overlaps the second horizontal part, with a second handle being coupled to one side of the third vertical parts;

a pair of bearings provided between the second horizontal part and the third horizontal part; and an upper cover rotating shaft coupled to the first horizontal part, the second horizontal part, and the third horizontal part by passing therethrough.

In addition, the frame may include:

a first frame having a first through hole formed in a center thereof, and at least one holding hole for the projectile formed along an outer circumferential surface thereof, the projectile being held in the holding hole; and a second frame, an outer circumferential surface of which is coupled to an edge of the first through hole of the first frame, and having a second through hole in a center of the second frame, the second through hole being perforated to have a first radius in a first angular range thereof and being perforated to have a second radius larger than the first radius in a second angular range thereof formed continuously with the first angular range, wherein a stopper mounted to a lower portion of the launch unit may be inserted to the portion of the second through hole perforated to have the second radius so as to limit a horizontal rotation angle of the launch unit.

In addition, the launch unit may include:

an upper case having a first opening part to which a gun barrel is coupled by passing therethrough, and having a second opening part formed by being spaced apart by a predetermined distance from the first opening part to prevent interference of the upper case with a lower case during a vertical rotation of the upper case;

a handle coupled to a rear portion of the upper case and used to change a direction of the gun barrel;

the lower case having a lower end portion, to which the stopper is coupled, arranged on an upper portion of the second frame, and having an upper end portion which has a gas chamber filled with the compressed gas supplied to the gun barrel; and a rotating shaft coupled to the gas chamber of the lower case and the upper case by passing therethrough such that the upper case is rotated relative to the gas chamber, wherein a third opening part may be formed in the gas chamber by corresponding to an open angle of the second opening part such that the gun barrel inserted into the gas chamber by passing through the first opening part is rotated in a vertical direction relative to the rotating shaft.

Furthermore, the launcher of the present invention may further include: an angle adjustment bracket configured to have a shape of an arc, a plurality of angle adjustment holes being formed along the arc, and coupled to an inner surface of the upper case;

a ball insertion part having a groove formed in a center thereof such that a spring is provided therein, and inserted to an insertion groove formed on an outer surface of the gas chamber;

an angle adjustment ball having a rear surface portion thereof inserted to the ball insertion part while being supported by the spring, and having a front surface portion thereof exposed to an outside being inserted to each of the angle adjustment holes of the angle adjustment bracket; and a fixed plate having a hole formed through a center thereof, the hole being smaller in diameter than the angle adjustment ball, and holding the front surface portion of the angle adjustment ball exposed to the outside, so that the fixed plate prevents the angle adjustment ball from being removed therefrom, wherein when an angle adjustment of the upper case in the vertical direction is performed by the handle, the angle adjustment ball may be inserted to the angle adjustment hole formed in the angle adjustment bracket, so that the angle adjustment of the upper case in the vertical direction may be performed in a step method.

Additionally, the launcher of the present invention may further include: a compressed gas injection pipe, an upper end of which passes through the lower case and is inserted into the gas chamber, and a lower end of which is connected to a firing gas tank via a first valve body;

the firing gas tank storing the compressed gas for firing the projectile when a launch button is pressed;

the first valve body receiving the compressed gas from the compressed gas tank and supplying the compressed gas to the firing gas tank and a second valve body before the firing, and supplying the compressed gas stored in the firing gas tank to the compressed gas injection pipe during the firing such that the projectile is fired;

the launch button; and the second valve body coupled to the launch button and discharging the compressed gas supplied to the second valve body to an outside during the pressing of the launch button such that the compressed gas stored in the firing gas tank is transmitted to the compressed gas injection pipe through the first valve body.

In addition, according to the present invention, during the opening of the upper cover of the launcher or the firing, a sensor may detect the opening or the firing, and then transmit a detection signal of the opening of the upper cover or the firing to a controller, the controller allowing accident information to be transmitted to a police department server, a fire department server, and a local government server such that follow-up measures are efficiently taken.

The stationary life-saving unit launcher of the present invention can rapidly launch the projectile without the loading motion.

In addition, the stationary life-saving unit launcher of the present invention can prevent the projectile from being launched toward people other than a drowning person so as to prevent accidents.

Furthermore, in the stationary life-saving unit launcher of the present invention, follow-up measures can be efficiently taken in case of accidents.

In addition to the above-described effects, specific effects of the present invention will be described below together with the description of specific details for embodying the present invention.

BRIEF DESCRIPTION OF THE DRAWINGS

FIG. 15(*b*) is a view illustrating the operation state of the first valve body according to the present invention.

FIG. 16(*b*) is a view illustrating the operation state of a second valve body according to the present invention.

DESCRIPTION OF THE REFERENCE NUMERALS IN THE DRAWINGS

Figure 1:
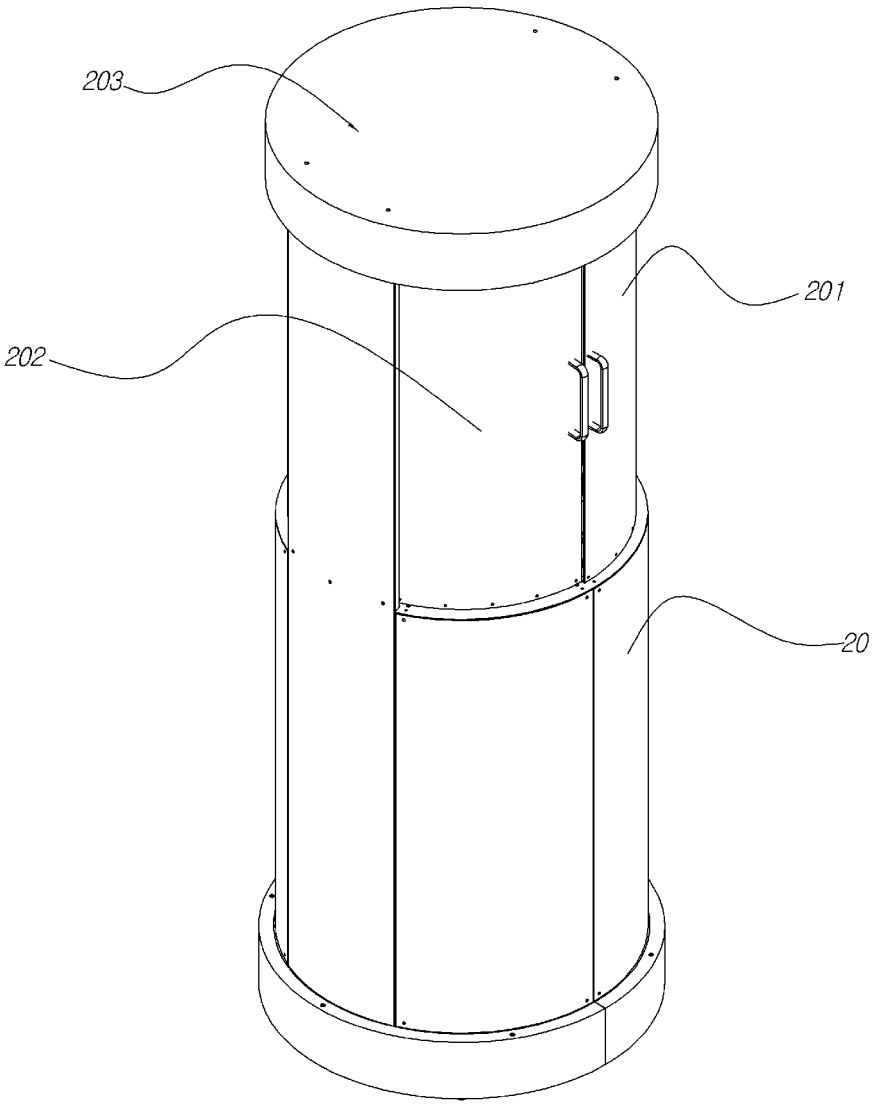
FIG. 1 is a perspective view of a stationary life-saving unit launcher according to the present invention.

20: Lower cover
21: Projectile
21*a*: Life-saving unit
21*b*: Connector
21*c*: Projectile mount
22: Compressed gas tank
22*a*: Tank support
23: Base
24: Second frame
24*a*: Firing gas tank
24*b*: Second through hole
25: First frame
25*a*: First through hole
25*b*: Holding hole for the projectile
30: Gun barrel
31: Upper case
31*a*: Second opening part
31*b*: First opening part
32: Handle
33: Launch button
34: Lower case
34*a*: Gas chamber
34*b*: Third opening part
36: Compressed gas injection pipe
A: Launch unit
40: Rotating shaft
100: First valve body
100*a*: Piston
101: One-touch fitting
102: Rotary joint
103: Second valve body
104: Stopper
105: Angle adjustment bracket
106: Ball insertion part
107: Angle adjustment ball
108: Fixed plate
200: First cover
201: Second cover
202: Third cover
203: Upper cap
700: Bearing
702: Upper cover rotating shaft
800: Compressed gas tank port
801: Second valve body port
802: Firing gas tank port
803: Compressed gas injection pipe port

DETAILED DESCRIPTION

A stationary life-saving unit launcher firing a life-saving unit 21*a* such that the life-saving unit reaches a distant target point includes:

a base 23;

a compressed gas tank 22 mounted to the upper portion of the base 23 and supplying compressed gas;

a frame mounted above the base 23 by being spaced apart by a predetermined distance therefrom; and a launch unit A mounted to the frame and firing the life-saving unit 21*a* by using the impact force of the compressed gas supplied from the compressed gas tank 22, wherein the launch unit A is capable of firing a projectile 21 without a loading motion for firing the life-saving unit 21*a* after the mounting thereof, and during the opening of an upper cover of the launcher, or the firing, a sensor detects the opening or the firing and then transmits a detection signal of the opening of the upper cover or the firing to a controller, the controller allowing accident information to be transmitted to a police department server, a fire department server, and a local government server such that follow-up measures are efficiently taken.

Hereinafter, the embodiment of the present document are described with reference to the accompanying drawings. However, this is not intended to limit the techniques described in this document to the specific embodiment, and it should be understood to include various modifications, equivalents, and/or alternatives of the embodiment of this document. In connection with the description of the drawings, similar reference numerals may be used for similar elements.

In addition, expressions such as "first", "second", etc. used in this document may modify various elements, regardless of order and/or importance, and are used to distinguish one component from another component, but do not limit the corresponding components.

For example, "the first part" and "the second part" may represent different parts regardless of order or importance. For example, without departing from the scope of the claims described in this document, a first component may be referred to as a second component, and similarly, the second component may be referred to as the first component.

In addition, terms used in this document are only used to describe the specific embodiment, and may not be intended to limit the scope of other embodiments. Singular expressions may include plural expressions unless the context clearly indicates otherwise. Terms used herein, including technical or scientific terms, may have the same meaning as commonly understood by one of ordinary skill in the technical field described in this document. Among the terms used in this document, terms defined in a general dictionary may be interpreted as having the same or similar meaning as the meaning in the context of the related technology, and unless explicitly defined in this document, are not interpreted as an ideal or excessively formal meaning. In some cases, even terms defined in this document cannot be construed to exclude the embodiment of this document.

Figure 2:
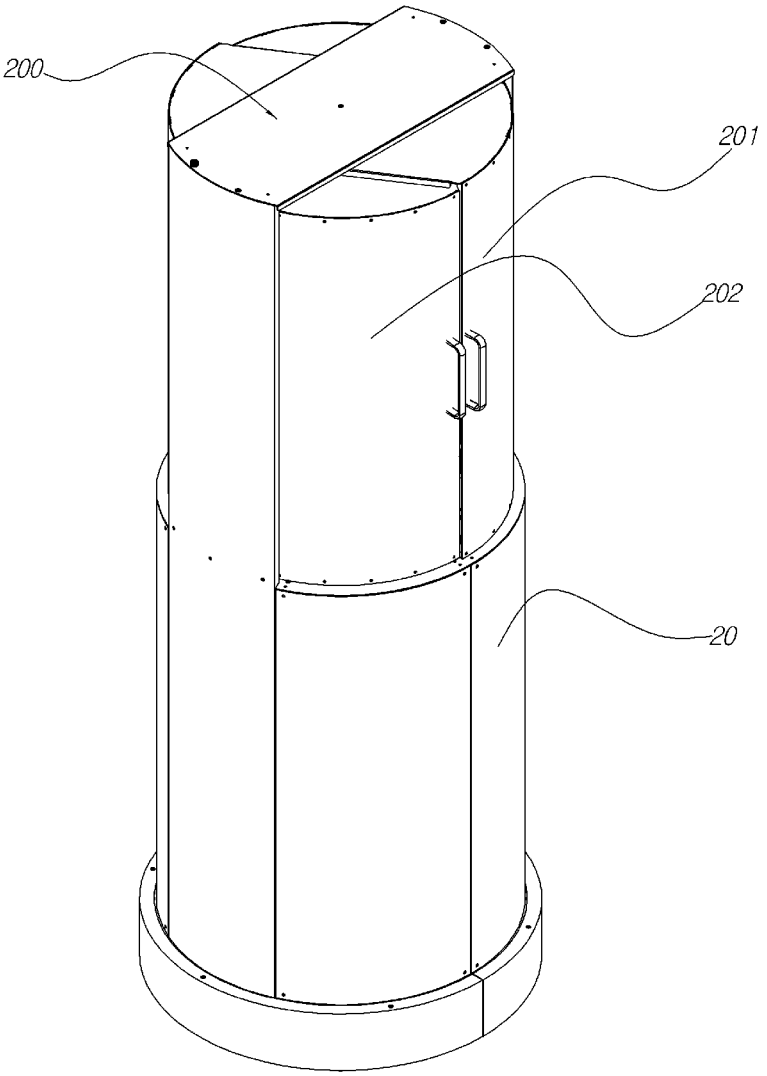
FIG. 2 is a perspective view illustrating the state of the stationary life-saving unit launcher having an upper cap removed in FIG. 1.
Figure 3:
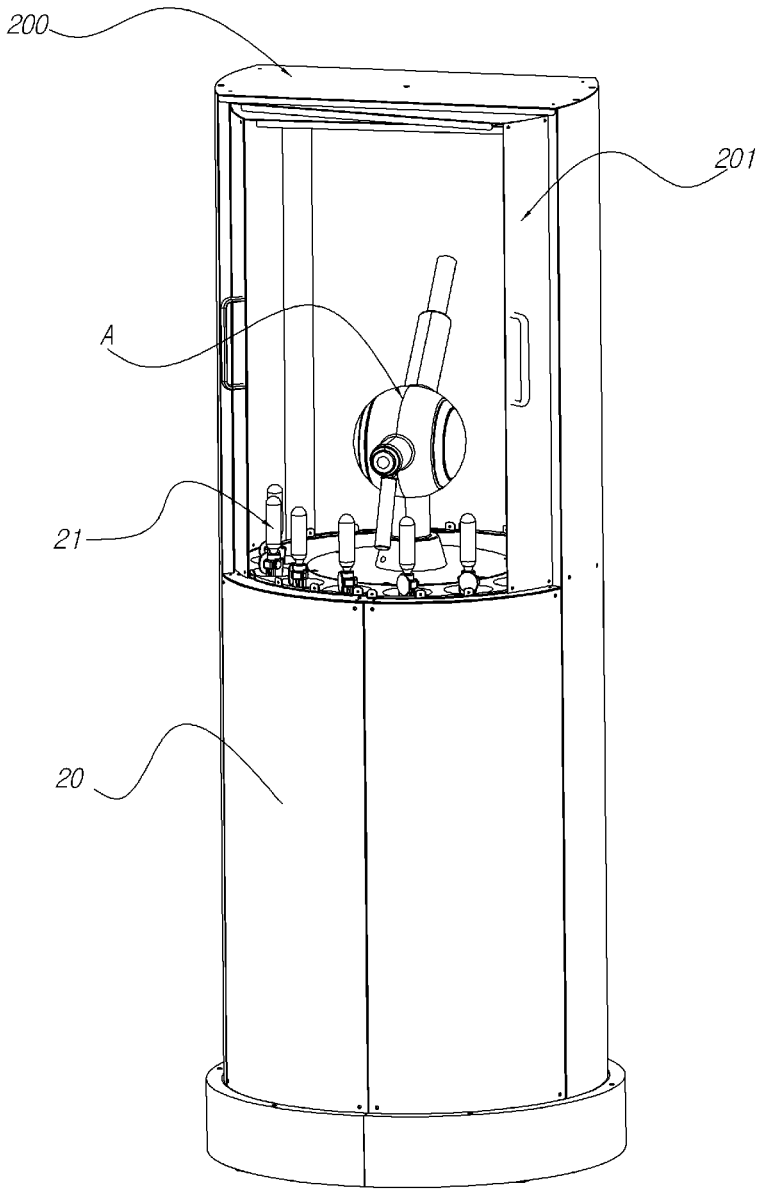
FIG. 3 is a perspective view illustrating a state in which an upper cover of the stationary life-saving unit launcher according to the present invention is open in the front portion and rear portion thereof.
Figure 4:
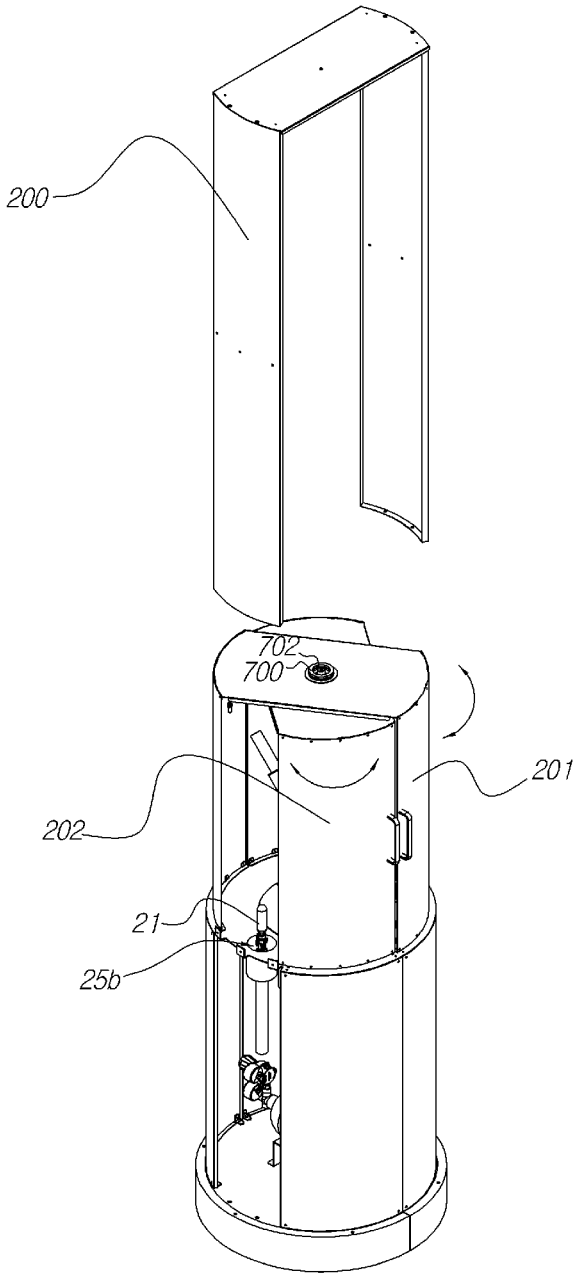
FIG. 4 is a view of the upper cover removed from the stationary life-saving unit launcher according to the present invention.
Figure 5:
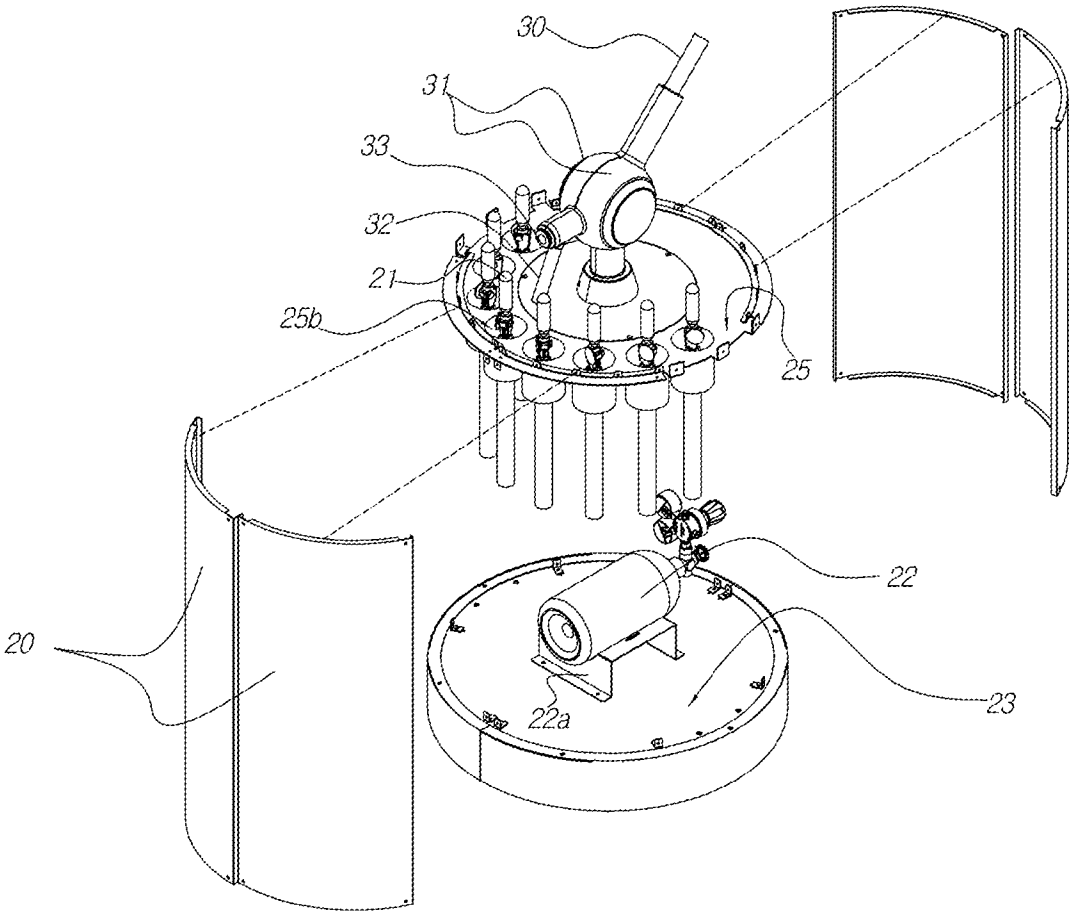
FIG. 5 is an exploded perspective view of a lower portion of the stationary life-saving unit launcher according to the present invention.

FIG. 1 is a perspective view of a stationary life-saving unit launcher according to the present invention; FIG. 2 is a perspective view illustrating the state of the stationary life-saving unit launcher having an upper cap 203 removed in FIG. 1; FIG. 3 is a perspective view illustrating a state in which an upper cover of the stationary life-saving unit launcher according to the present invention is open in the front portion and rear portion thereof; FIG. 4 is a view of the upper cover removed from the stationary life-saving unit launcher according to the present invention; and FIG. 5 is an exploded perspective view of a lower portion of the stationary life-saving unit launcher according to the present invention.

The stationary life-saving unit launcher of the present invention will be described with reference to FIGS. 1 to 5.

The stationary life-saving unit launcher of the present invention is fixed to a predetermined position to fire the life-saving unit such that the life-saving unit reaches a distant target point.

The life-saving unit launcher includes the base 23, the compressed gas tank 22, the frame, and the launch unit A.

Particularly, the launch unit A of the present invention is capable of firing the projectile 21 without a loading motion for firing the life-saving unit after the mounting thereof. Accordingly, a rapid response to accidents is possible.

The base 23 is arranged at the lowest portion of the launcher, and the compressed gas tank 22 is mounted to the upper portion of the base 23.

The compressed gas tank 22 stores and supplies the compressed gas for firing the projectile 21. Carbon dioxide, which is an inert gas, is preferably used as the compressed gas, but the compressed gas is not limited thereto.

A support may be provided on the upper surface of the base 23 to support the compressed gas tank 22.

A lower cover 20 is coupled to the upper portion of the base 23 so as to cover the upper circumference of the base 23. This is intended to prevent outsiders from approaching the compressed gas 22 by blocking the compressed gas tank 22 from being exposed to the outside.

The frame is arranged above the base 23 by being spaced apart by a predetermined distance from the base 23. The frame supports the launch unit A to be described later.

The frame is coupled to the upper end portion of the lower cover 20.

The upper cover is provided to cover the upper circumference of the frame.

As for the upper cover according to the present invention, to protect people adjacent to the launcher, only the front portion of the upper cover at which a gun barrel 30 of the launch unit A is arranged and the rear portion of the upper cover at which a launch button 33 of the launch unit A is arranged can be opened and closed such that side surfaces except for the front portion and the rear portion are closed.

Meanwhile, for the convenience of use, the front portion at which the gun barrel 30 of the launch unit A is arranged and the rear portion at which the launch button 33 of the launch unit A is arranged are designed to be simultaneously opened or closed.

Referring to FIG. 4, the upper cover according to the present invention includes a first cover 200, a second cover 201, a third cover 202, a pair of bearings 700, and an upper cover rotating shaft 702.

The first cover 200 is configured to have a U shape formed by two first vertical parts and a first horizontal part connecting the two first vertical parts to each other.

The first cover is fixed to the upper portion of the base 23 such that the first horizontal part is directed upward. When the upper cover is opened, the second cover 201 and the third cover 202 are arranged inside the first vertical parts of the first cover 200.

The second cover 201 is configured to have a U shape formed by two second vertical parts and a second horizontal part connecting the two second vertical parts to each other.

The second cover 201 is arranged on the upper portion of the frame A such that the second horizontal part is directed upward, with a first handle 32 being coupled to one side of the second vertical parts.

The second cover 201 and the third cover 202 which is described later are not fixed to the upper portion of the frame, and are arranged to be opened or closed.

The third cover 202 has a U shape formed by two third vertical parts and a third horizontal part connecting the two third vertical parts to each other, and a second handle 32 is coupled to one side of the third vertical parts.

The third horizontal part is arranged on the upper portion of the frame such that the third horizontal part is directed upward and overlaps the second horizontal part.

A pair of bearings 700 are provided between the second horizontal part and the third horizontal part.

In addition, the upper cover rotating shaft 702 is coupled to the first horizontal part, the second horizontal part, and the third horizontal part by passing therethrough.

Due to such a structure, the front portion of the upper cover at which the gun barrel 30 of the launch unit A is arranged and the rear portion of the upper cover at which the launch button 33 of the launch unit A is arranged can be simultaneously opened or closed.

Figure 6:
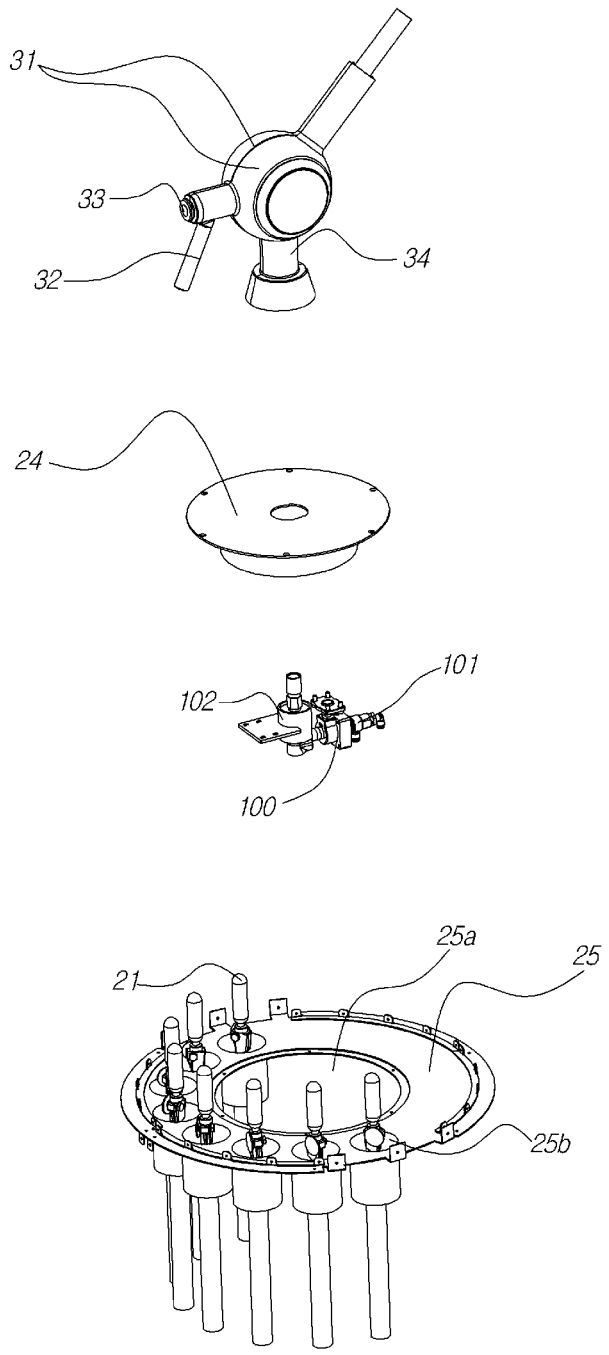
FIG. 6 is a view illustrating a state in which a launch unit, a frame, and a first valve body according to the present invention are separated from each other.
Figure 7:
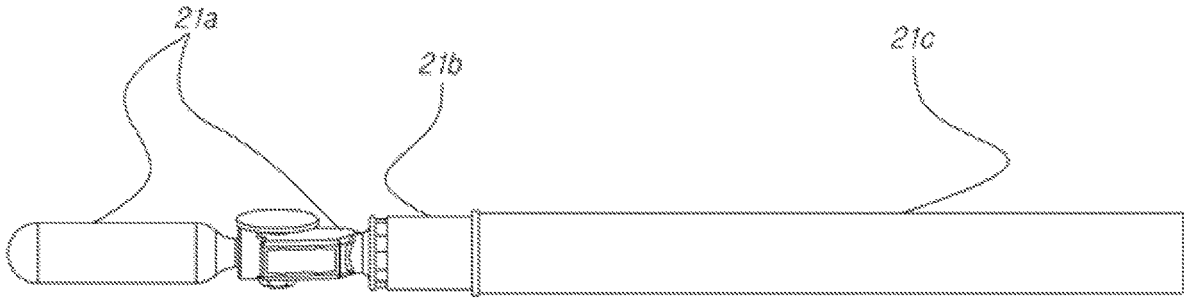
FIG. 7 is a side view of a projectile according to the present invention.
Figure 8:
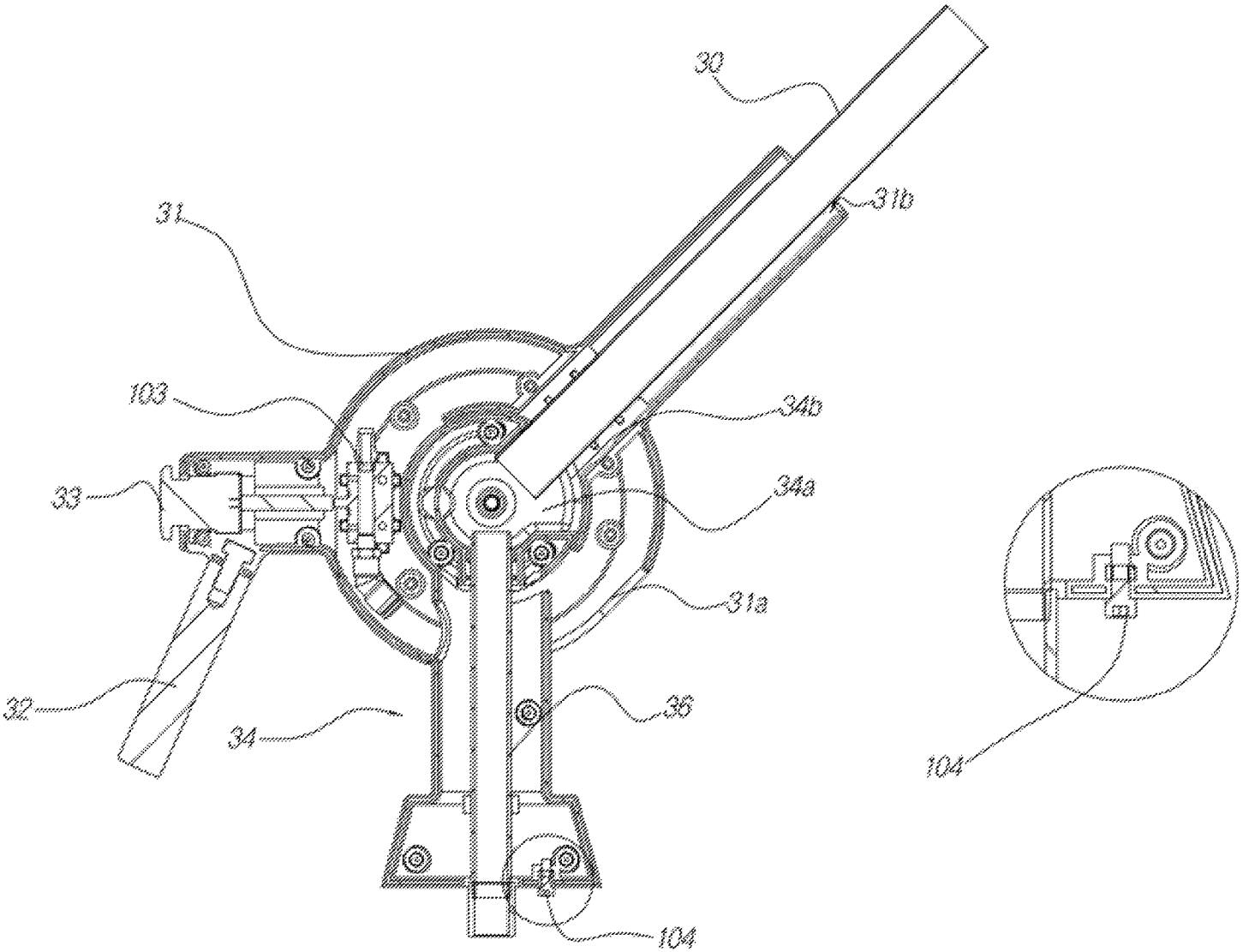
FIG. 8 is a sectional view of the launch unit according to the present invention.
Figure 9:
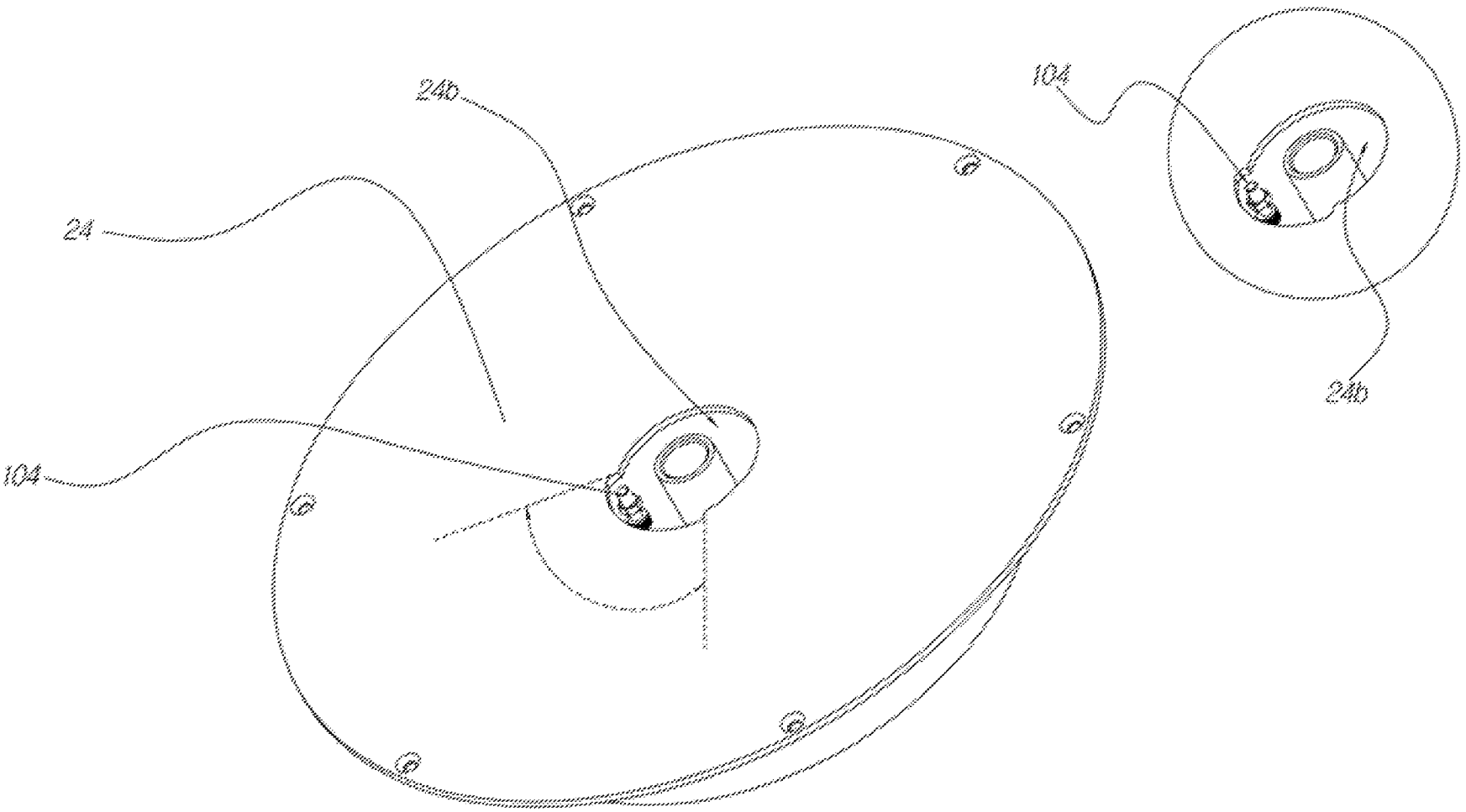
FIG. 9 is a perspective view of a second frame according to the present invention.

FIG. 6 is a view illustrating a state in which a launch unit A, the frame, and a first valve body 100 according to the present invention are separated from each other; FIG. 7 is a side view of the projectile 21 according to the present invention; FIG. 8 is a sectional view of the launch unit A according to the present invention; and FIG. 9 is a perspective view of a second frame 24 according to the present invention.

The present invention will be described with reference to FIGS. 6 to 9.

The frame of the present invention includes a first frame 25 and the second frame 24.

The first frame 25 has a first through hole 25*a* formed in the center thereof, and the second frame 24 to be described later is inserted to the first through hole 25*a* and coupled to the first frame 25.

At least one holding hole for the projectile 21 in which the projectile 21 is held is formed along the outer circumferential surface of the first frame 25.

A user fires the projectile 21 after removing the projectile 21 held in the holding hole for the projectile 21 therefrom, and loading the projectile 21 into the gun barrel 30, and without any other preparation work, can continuously fire another projectile 21 by continuously loading the another projectile 21 into the gun barrel 30.

The projectile 21 includes the life-saving unit 21*a*, a connector 21*b*, and a projectile mount 21*c*.

The life-saving unit 21*a* is arranged at the front portion of the projectile 21, and next the connector 21*b* is coupled to an end of the life-saving unit 21*a*.

The connector 21*b* is a structure connecting the life-saving unit 21*a* to the projectile mount 21*c*.

The projectile mount 21*c* is formed in a pipe shape with a hollow portion formed therein, and is coupled to the surface of the gun barrel 30.

The projectile mount 21*c* is intended to stably mount the projectile 21 to the outer circumferential surface of the gun barrel 30 and to increase flying distance thereof.

The second frame 24 is a structure supporting the launch unit A, and is designed such that the launch unit A is rotated within a limited angular range in a horizontal direction.

The outer circumferential surface of the second frame 24 is coupled to the edge of the first through hole 25*a* of the first frame 25.

A second through hole 24*b* is formed in the center of the second frame 24, the second through hole being perforated to have a first radius in a first angular range thereof, and being perforated to have a second radius larger than the first radius in a second angular range thereof formed continuously with the first angular range.

A stopper 104 is mounted to the lower portion of the launch unit A. The stopper 104 is inserted into the portion of the second through hole 24*b* perforated to have the second radius, and interferes with a side wall of the portion of the second through hole perforated to have the second radius during the rotation of the launch unit A in the horizontal direction so that the horizontal rotation angle of the launch unit is limited.

The launch unit A according to the present invention is preferably capable of rotating in an angular range of 120 degrees in the horizontal direction.

Figure 10:
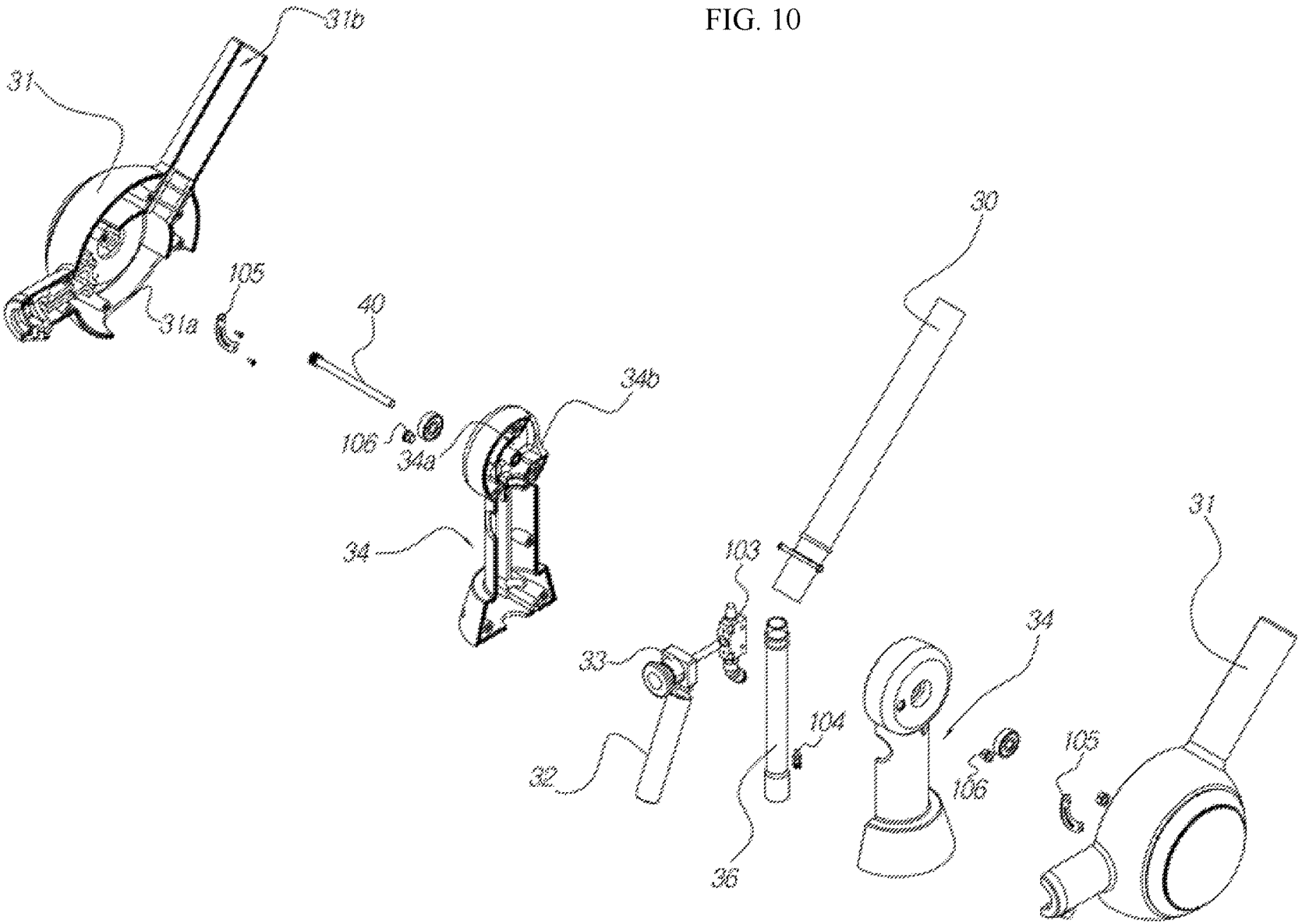
FIG. 10 is an exploded perspective view of the launch unit according to the present invention.
Figure 11:
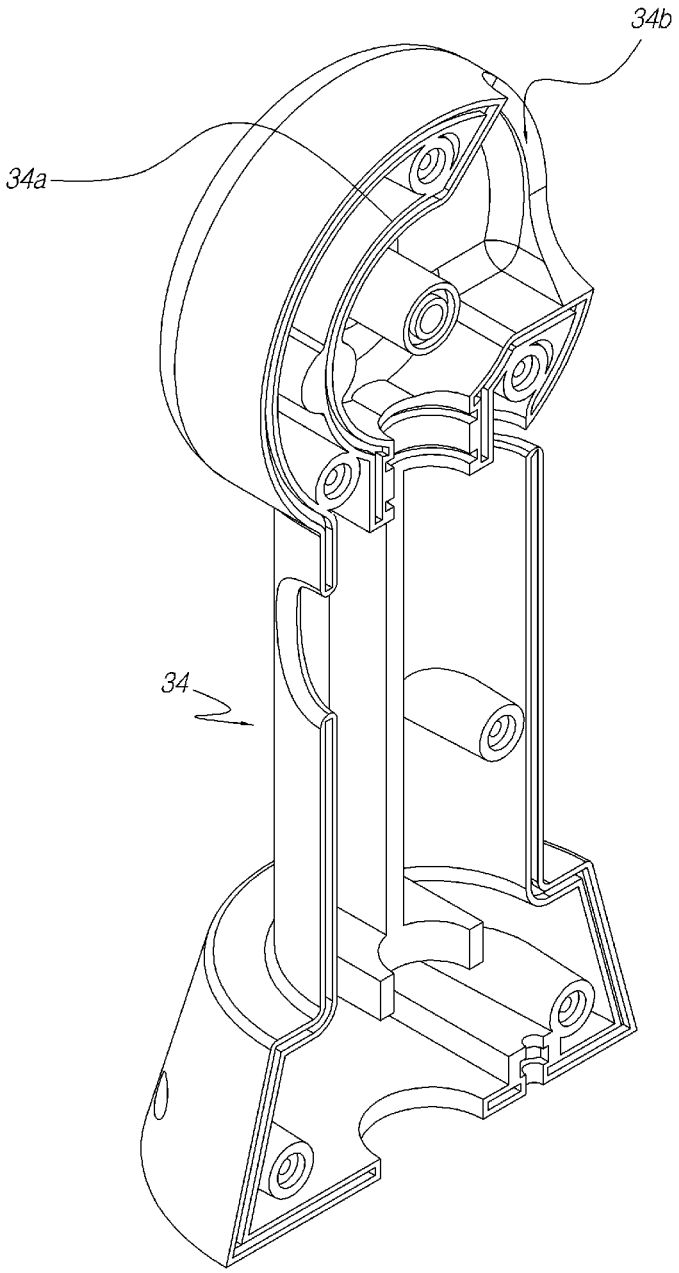
FIG. 11 is a perspective view of a lower case according to the present invention.
Figure 12:
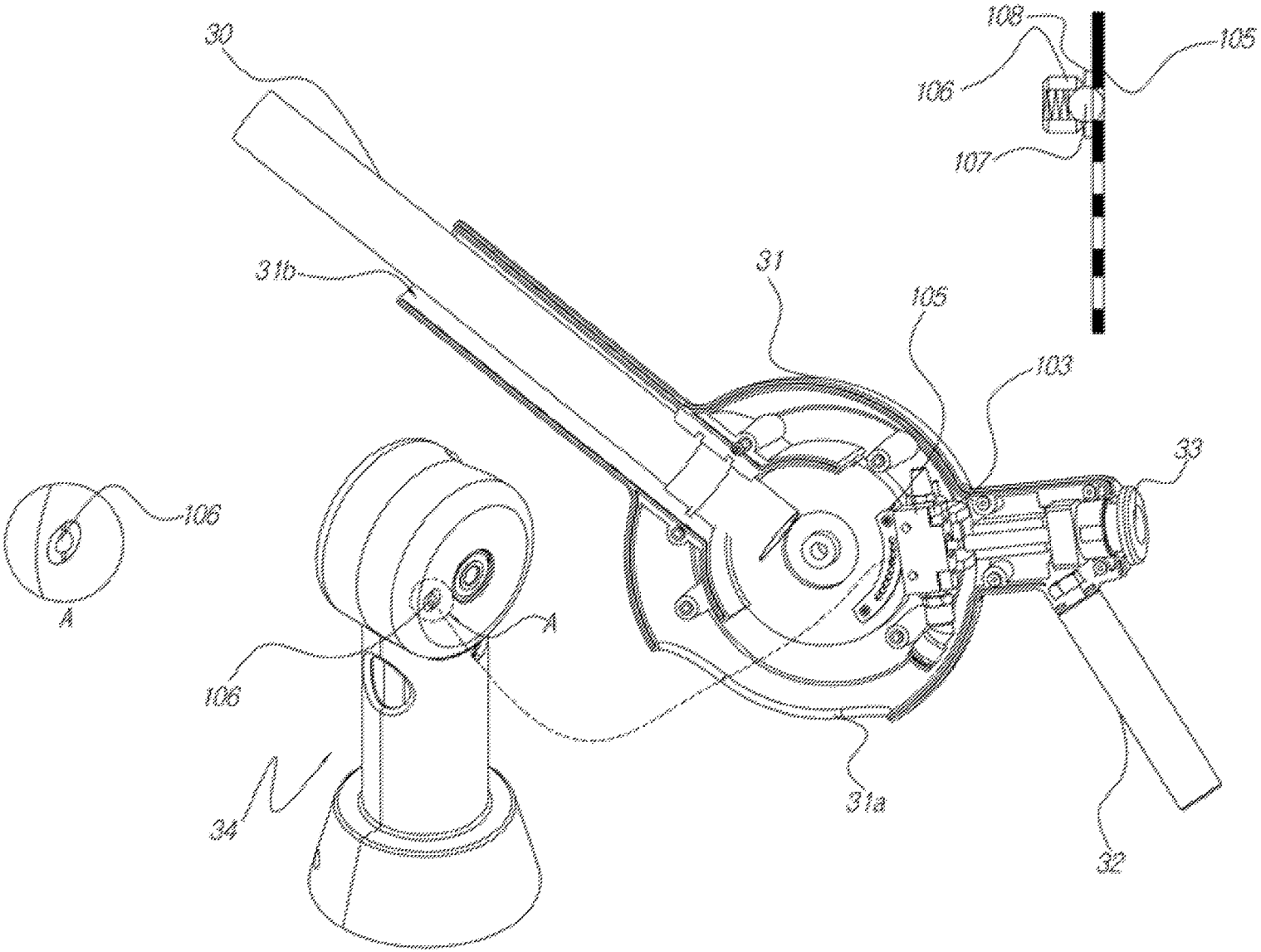
FIG. 12 is a view illustrating a state in which an angle adjustment ball is inserted to an angle adjustment bracket according to the present invention.
Figure 13:
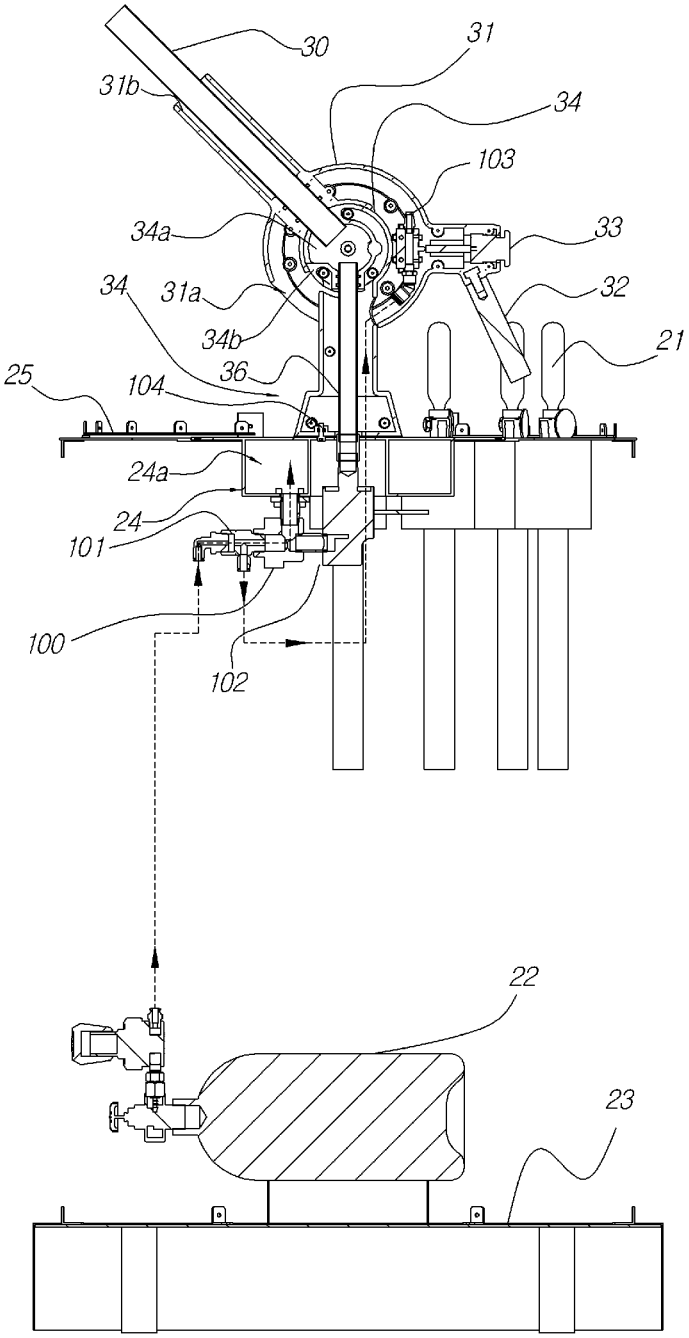
FIG. 13 is a view illustrating a path through which compressed gas is supplied before firing the projectile in the launch unit according to the present invention.
Figure 14:
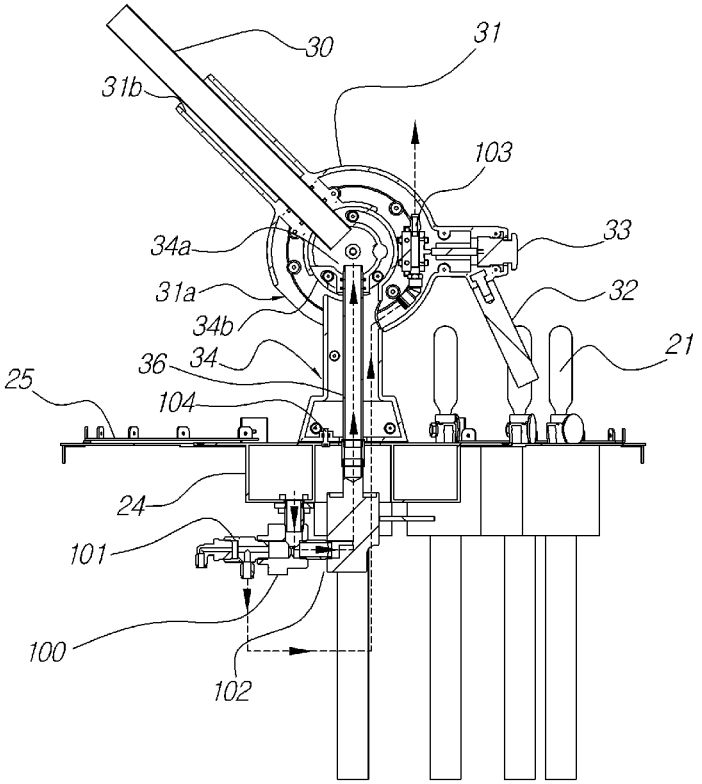
FIG. 14 is a view illustrating a path through which the compressed gas is supplied after the firing in the launch unit according to the present invention.
Figure 14:
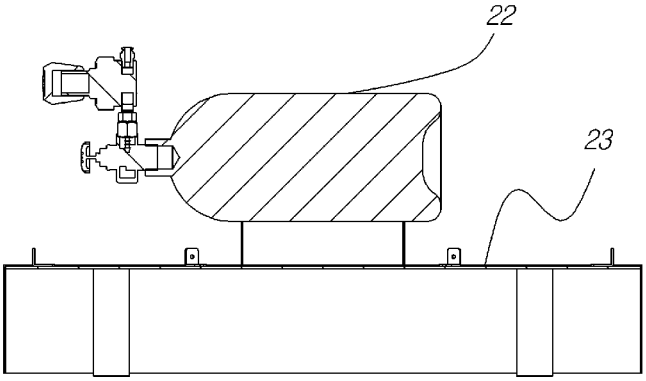
Figure 15A:
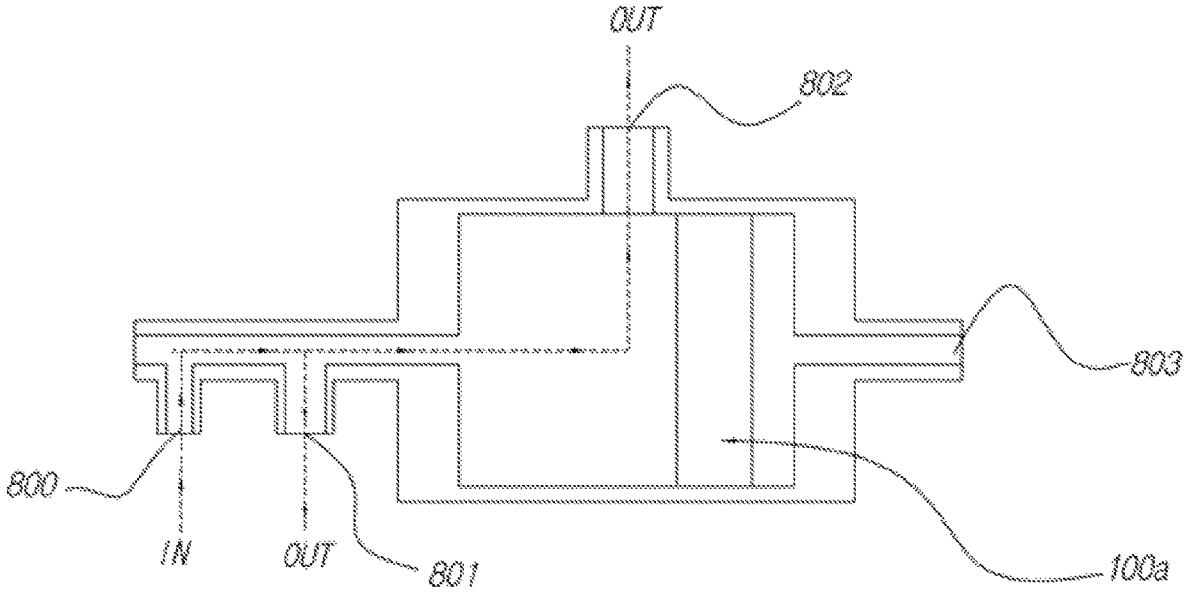
FIG. 15(*a*) is a view illustrating the operation state of the first valve body according to the present invention.
Figure 15B:
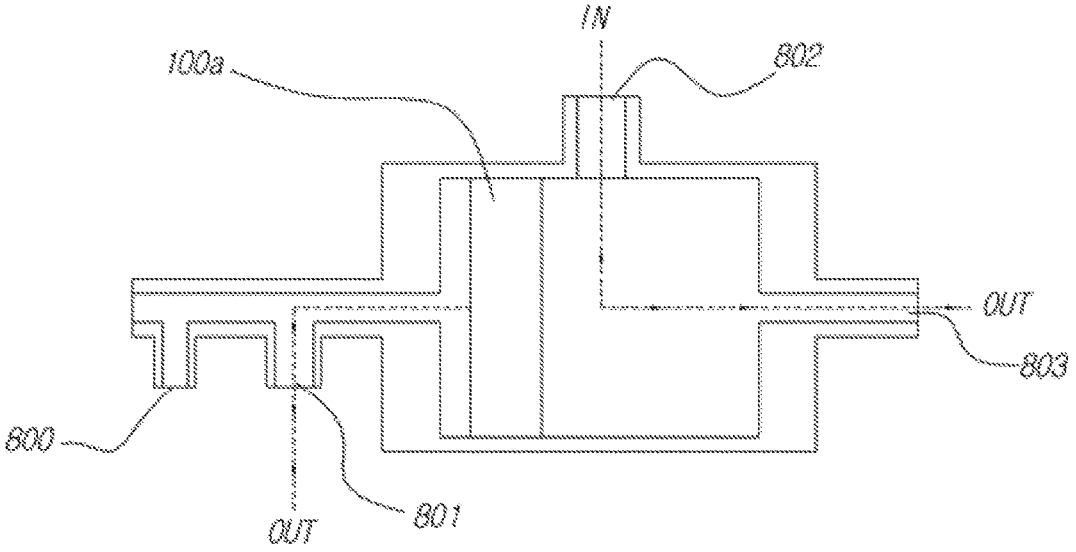

FIG. 10 is an exploded perspective view of the launch unit A according to the present invention; FIG. 11 is a perspective view of a lower case 34 according to the present invention; FIG. 12 is a view illustrating a state in which an angle adjustment ball 107 is inserted to an angle adjustment bracket 105 according to the present invention; FIG. 13 is a view illustrating a path through which compressed gas is supplied before the firing in the launch unit A according to the present invention; FIG. 14 is a view illustrating a path through which the compressed gas is supplied after the firing in the launch unit A according to the present invention; FIGS. 15(*a*) and 15(*b*) are views illustrating the operation state of the first valve body 100 according to the present invention; and FIGS. 16(*a*) and 16(*b*) are views illustrating the operation state of a second valve body 103 according to the present invention.

The launch unit A will be described with reference to FIGS. 10, 16(*a*) and 16(*b*).

The launch unit A includes an upper case 31, a handle 32, the lower case 34, and a rotating shaft 40.

The upper case 31 is a case covering the upper portion of the launch unit A.

A first opening part 31*b* to which the gun barrel 30 is coupled by passing therethrough is formed on the front portion of the upper case 31.

In addition, to prevent the interference of the upper case 31 with the lower case 34 during the rotation of the upper case 31 in the vertical direction, a second opening part 31*a* is formed in the lower portion of the upper case 31 by being spaced apart by a predetermined distance from the first opening part 31*b*.

The handle 32 is coupled to the rear portion of the upper case 31 and used to change the direction of the gun barrel 30.

The lower case 34 covers the lower portion of the launch unit A, and supplies compressed gas supplied from the compressed gas tank 22 to the gun barrel 30.

The stopper 104 is coupled to the lower end portion of the lower case 34, and as described above, limits the horizontal rotation angle of the launch unit A.

The lower end portion of the lower case 34 coupled to the stopper 104 is arranged on the second frame 24, and a gas chamber 34*a* filled with the compressed gas supplied to the gun barrel 30 is provided on the upper end portion of the lower case 34.

The rotating shaft 40 is coupled to the gas chamber 34*a* of the lower case 34 and the upper case 31 by passing therethrough. Accordingly, the upper case 31 can be rotated relative to the gas chamber 34*a*. That is, the upper case 31 can be rotated relative to the lower case 34 in a vertical direction.

A third opening part 34*b* is formed in the gas chamber 34*a* by corresponding to the open angle of the second opening part 31*a* such that the gun barrel 30 inserted into the gas chamber 34*a* by passing through the first opening part 31*b* is rotated in the vertical direction relative to the rotating shaft 40.

The gun barrel 30 of the launch unit A of the present invention is preferably rotatable in an angle range of 45 degrees up and down.

Accordingly, the launch unit A of the present invention is allowed to be rotated only in the limited angle range up and down, and left and right such that people adjacent to the launcher do not have unintended accidents.

The upper case 31 of the present invention can perform an angle adjustment in a step method when rotating in the vertical direction such that a user can finely perform the angle adjustment.

To this end, in the present invention, the angle adjustment bracket 105, a ball insertion part 106, the angle adjustment ball 107, and a fixed plate 108 are provided.

The angle adjustment bracket 105 is configured to have a shape of an arc, a plurality of angle adjustment holes being formed along the arc, and is coupled to the inner surface of the upper case 31.

The ball insertion part 106 has a groove formed in the center thereof so that a spring is provided therein, and is inserted to an insertion groove formed on the outer surface of the gas chamber 34*a*.

The rear surface portion of the angle adjustment ball 107 is inserted to the ball insertion part 106 while being supported by the spring, and the front surface portion thereof exposed to the outside is inserted to each of the angle adjustment holes of the angle adjustment bracket 105.

The fixed plate 108 has a hole formed through the center thereof, the hole being smaller in diameter than the angle adjustment ball 107, and holds the front surface portion of the angle adjustment ball 107 exposed to the outside, so that the fixed plate prevents the angle adjustment ball 107 from being removed therefrom.

Accordingly, a user can perform the fine angle adjustment by recognizing the click sound of the angle adjustment ball 107 being inserted into each hole whenever the handle 32 is moved in the vertical direction.

A method in which the projectile 21 of the launch unit A according to the present invention is fired will be described.

For firing the projectile 21, a compressed gas injection pipe 36, a firing gas tank 24*a*, the first valve body 100, the launch button 33, and the second valve body 103 are provided.

The compressed gas injection pipe 36 supplies gas of the firing gas tank 24*a* stored for firing the projectile 21 to the gas chamber 34*a*.

The upper end of the compressed gas injection pipe 36 is inserted into the gas chamber 34*a*, and the lower end thereof is connected to the firing gas tank 24*a* via the first valve body 100.

The firing gas tank 24*a* stores the compressed gas for firing the projectile 21 when the launch button 33 is pressed, and is provided on the lower portion of the second frame 24.

Before the firing, the first valve body 100 receives the compressed gas from the compressed gas tank 22, and supplies the compressed gas to the firing gas tank 24*a* and the second valve body 103, and during the firing, the compressed gas stored in the firing gas tank 24*a* is supplied to the compressed gas injection pipe 36 so that the projectile 21 is fired.

FIG. 15(*a*) is a view illustrating the operation state of the first valve body 100 before the firing, and FIG. 15(*b*) is a view illustrating the operation state of the first valve body 100 after the firing.

Referring to FIG. 15(*a*), before the firing, compressed gas is supplied from a compressed gas tank port 800, and is transmitted to a firing gas tank port 802 and a second valve body port 801.

In this case, a piston 100*a* located inside the first valve body 100 closes the compressed gas injection pipe port 803 such that the compressed gas is not transmitted to the gas chamber 34*a*.

Accordingly, before the firing, the firing gas tank 24*a* and the second valve body 103 are filled with the compressed gas.

Referring to FIG. 15(*b*), after the firing, when the compressed gas is discharged in large quantities to the second valve body port larger in diameter than the compressed gas tank port, the piston 100*a* located inside the first valve body 100 moves to a left side in the drawing. Accordingly, the compressed gas tank port and the second valve body port 801 are closed, and the firing gas tank port 802 and the gas chamber port are opened.

As a result, the compressed gas stored in the firing gas tank 24*a* is transmitted through the compressed gas injection pipe 36 to the gas chamber 34*a* so as to fire the projectile 21.

The second valve body 103 is coupled to the launch button 33.

When the launch button 33 is pressed, the second valve body 103 discharges the compressed gas supplied thereto to the outside, and the compressed gas stored in the firing gas tank 24*a* is transmitted through the first valve body 100 to the compressed gas injection pipe 36.

Figure 16A:
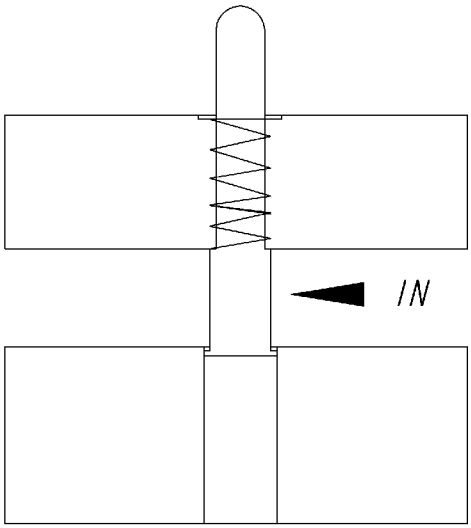
FIG. 16(*a*) is a view illustrating the operation state of a second valve body according to the present invention.
Figure 16B:
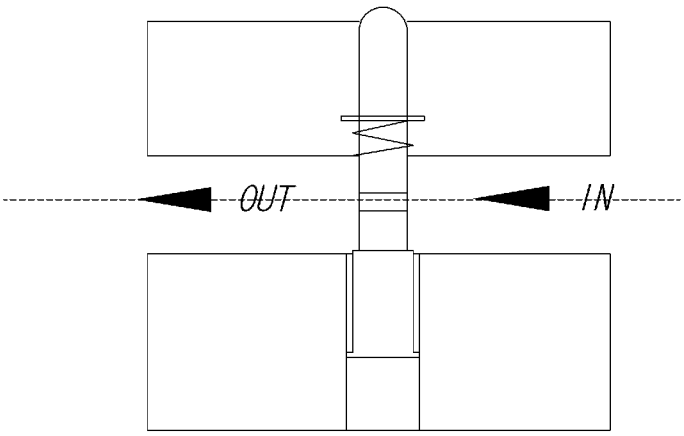

FIG. 16(*a*) is a view illustrating the operation state of the second valve body 103 before the firing, and FIG. 16(*b*) is a view illustrating the operation state of the second valve body 103 after the firing.

Referring to FIG. 16(*a*), before the launch button 33 is pressed, the compressed gas supplied from the first valve body 100 is blocked from being discharged to the outside, and is filled in the second valve body 103.

Referring to FIG. 14(*b*), when the launch button 33 is pressed, the compressed gas filled in the second valve body 103 is discharged to the outside so that the piston 100*a* located inside the first valve body 100 is moved.

In the launch unit A of the present invention which is designed to have such a structure, when the projectile 21 is loaded into the gun barrel 30, the projectile 21 is immediately fired by the pressing of the launch button 33. After the firing, gas injection to the firing gas tank 24*a* is performed in a short time, so another projectile 21 can be continuously fired.

Meanwhile, the life-saving unit launcher of the present invention is provided with the controller (not shown). During the opening of the upper cover or the firing, the sensor detects the opening or the firing, and transmits the detection signal of the opening of the upper cover or the firing to the controller.

The controller allows accident information to be transmitted to a police department server, a fire department server, and a local government server such that follow-up measures are efficiently taken.

Meanwhile, a pressure gauge equipped with wireless communication function detects the pressure of the compressed gas tank 22 and transmits the pressure to the manager server. When the detected pressure of the compressed gas tank 22 falls to a predetermined pressure or less, the manager server allows the compressed gas to be supplied thereto, so the life-saving unit launcher can be maintained in an operable state.

The exemplary embodiment of the present invention has been illustrated and described, but the present invention is not limited to the specific embodiment described above. The present invention is of course possible to be implemented by being variously modified by those having ordinary skill in the technical field to which the present invention belongs without departing from the gist of the present invention claimed in the accompanying claims. These modified embodiments should not be individually understood from the technical idea or prospect of the present invention.

According to the stationary life-saving unit launcher of the present invention, the projectile can be rapidly launched without a loading motion; the projectile can be prevented from being launched toward people other than a downing person so as to prevent accidents; and follow-up measures can be efficiently taken in case of accidents. Accordingly, the stationary life-saving unit launcher of the present invention is very high in industrial applicability.

The invention claimed is:

1. A stationary life-saving unit launcher firing a life-saving unit such that the life-saving unit reaches a distant target point, the launcher comprising:

a base;

a compressed gas tank mounted to an upper portion of the base and supplying compressed gas;

a frame mounted above the base by being spaced apart by a predetermined distance therefrom; and a launch unit mounted to the frame and firing the life-saving unit by using an impact force of the compressed gas supplied from the compressed gas tank, wherein the launch unit is capable of firing a projectile without a loading motion of moving a loading handle backward for firing the life-saving unit after mounting thereof, and during opening of an upper cover of the launcher or the firing, a sensor detects the opening or the firing, and then transmits a detection signal of the opening of the upper cover or the firing to a controller, the controller allowing accident information to be transmitted to a police department server, a fire department server, and a local government server such that follow-up measures are efficiently taken, wherein the stationary life-saving unit launcher further comprises:

a lower cover covering an upper circumference of the base; and the upper cover covering an upper circumference of the frame, wherein a front portion of the upper cover at which a gun barrel of the launch unit is arranged and a rear portion of the upper cover at which a launch button of the launch unit is arranged are simultaneously opened or closed.

2. The launcher of claim 1, wherein the upper cover comprises:

a first cover having a U shape formed by two first vertical parts and a first horizontal part connecting the two first vertical parts to each other, the first cover being fixed to the upper portion of the base such that the first horizontal part is directed upward;

a second cover having a U shape formed by two second vertical parts and a second horizontal part connecting the two second vertical parts to each other, and being arranged on an upper portion of the frame such that the second horizontal part is directed upward, with a first handle being coupled to one side of the second vertical parts;

a third cover having a U shape formed by two third vertical parts and a third horizontal part connecting the two third vertical parts to each other, and being arranged on the upper portion of the frame such that the third horizontal part is directed upward and overlaps the second horizontal part, with a second handle being coupled to one side of the third vertical parts;

a pair of bearings provided between the second horizontal part and the third horizontal part; and an upper cover rotating shaft coupled to the first horizontal part, the second horizontal part, and the third horizontal part by passing therethrough.

3. The launcher of claim 1, wherein the frame comprises:

a first frame having a first through hole formed in a center thereof, and at least one holding hole for the projectile formed along an outer circumferential surface thereof, the projectile being held in the holding hole; and a second frame, an outer circumferential surface of which is coupled to an edge of the first through hole of the first frame, and having a second through hole in a center of the second frame, the second through hole being perforated to have a first radius in a first angular range thereof and being perforated to have a second radius larger than the first radius in a second angular range thereof formed continuously with the first angular range, wherein a stopper mounted to a lower portion of the launch unit is inserted to the portion of the second through hole perforated to have the second radius so as to limit a horizontal rotation angle of the launch unit.

4. The launcher of claim 3, wherein the launch unit comprises:

an upper case having a first opening part to which a gun barrel is coupled by passing therethrough, and having a second opening part formed by being spaced apart by a predetermined distance from the first opening part to prevent interference of the upper case with a lower case during a vertical rotation of the upper case;

a handle coupled to a rear portion of the upper case and used to change a direction of the gun barrel;

the lower case having a lower end portion, to which the stopper is coupled, arranged on an upper portion of the second frame, and having an upper end portion which has a gas chamber filled with the compressed gas supplied to the gun barrel; and a rotating shaft coupled to the gas chamber of the lower case and the upper case by passing therethrough such that the upper case is rotated relative to the gas chamber, wherein a third opening part is formed in the gas chamber by corresponding to an open angle of the second opening part such that the gun barrel inserted into the gas chamber by passing through the first opening part is rotated in a vertical direction relative to the rotating shaft.

5. The launcher of claim 4, further comprising:

an angle adjustment bracket configured to have a shape of an arc, a plurality of angle adjustment holes being formed along the arc, and coupled to an inner surface of the upper case;

a ball insertion part having a groove formed in a center thereof such that a spring is provided therein, and inserted to an insertion groove formed on an outer surface of the gas chamber;

an angle adjustment ball having a rear surface portion thereof inserted to the ball insertion part while being supported by the spring, and having a front surface portion thereof exposed to an outside being inserted to each of the angle adjustment holes of the angle adjustment bracket; and a fixed plate having a hole formed through a center thereof, the hole being smaller in diameter than the angle adjustment ball, and holding the front surface portion of the angle adjustment ball exposed to the outside, so that the fixed plate prevents the angle adjustment ball from being removed therefrom, wherein when an angle adjustment of the upper case in the vertical direction is performed by the handle, the angle adjustment ball is inserted to the angle adjustment hole formed in the angle adjustment bracket, so that the angle adjustment of the upper case in the vertical direction is performed in a step method.

6. The launcher of claim 4, further comprising:

a compressed gas injection pipe, an upper end of which passes through the lower case and is inserted into the gas chamber, and a lower end of which is connected to a firing gas tank via a first valve body;

the firing gas tank storing the compressed gas for firing the projectile when a launch button is pressed;

the first valve body receiving the compressed gas from the compressed gas tank and supplying the compressed gas to the firing gas tank and a second valve body before the firing, and supplying the compressed gas stored in the firing gas tank to the compressed gas injection pipe during the firing such that the projectile is fired;

the launch button; and the second valve body coupled to the launch button and discharging the compressed gas supplied to the second valve body to an outside during the pressing of the launch button such that the compressed gas stored in the firing gas tank is transmitted to the compressed gas injection pipe through the first valve body.

* * * * *